US005299703A

United States Patent [19]

Cater

[11] Patent Number: 5,299,703

[45] Date of Patent: Apr. 5, 1994

[54] DEVICE FOR SECURING A DISPENSER TO A GLASS CONTAINER

[75] Inventor: Miro S. Cater, Newtown, Conn.

[73] Assignee: American Dispensing Systems Inc., Newtown, Conn.

[21] Appl. No.: 83,480

[22] Filed: Jun. 30, 1993

[51] Int. Cl.[5] ..... B65D 47/00

[52] U.S. Cl. ..... 215/274; 222/321

[58] Field of Search ..... 215/273, 274, 276, 277, 215/292; 222/153, 321

[56] References Cited

U.S. PATENT DOCUMENTS

| | | | |
|---|---|---|---|
| 4,366,921 | 1/1983 | Kirk, Jr. | 215/274 |
| 4,773,553 | 9/1988 | van Bracklin | 215/274 |
| 4,984,702 | 1/1991 | Pierpont | 215/274 |
| 5,069,369 | 12/1991 | McGarity | 215/274 |
| 5,181,632 | 1/1993 | Latter | 215/274 |

*Primary Examiner*—Joseph Man-Fu Moy

[57] ABSTRACT

A device for connecting a dispenser having a circular outer periphery with a first diameter to a glass container having a flanged open neck, which employs a flat circular non metallic ring shaped gasket engaging the upper surface of the flange. A metal ferrule has a flat circular top with an opening through which the dispenser extends. The top overlies and engages the upper surface of the gasket. A vertical hollow cylinder having an upper end coincident with the top extends downward along the outer vertical surface of the flange with a lower end terminating in a plurality of spaced fingers. A second vertical cylinder having a central opening through which the dispenser extends, extends vertically downward along the outside surface of the first cylinder past the spaced fingers, the inner surface of the second cylinder engaging the fingers and forcing them into locking engagement with the outer surface of the flange.

6 Claims, 7 Drawing Sheets 100
106
118
116
104
108
110
119
102
112

DEVICE FOR SECURING A DISPENSER TO A GLASS CONTAINER

BACKGROUND OF THE INVENTION

Dispensers such as pumps and various valves for delivering liquids out of glass containers having flanged necks typically are secured to such containers by "crimping", that is by mechanically folding a metal skirt around the flanged neck of the container. However, this method requires specialized equipment and often results in inadequate sealing or costly breakage of glass.

One solution to this problem, as taught in U.S. Pat. No. 4,773,553, employs a plastic member which is distorted by a surrounding sleeve in such manner that the member is secured and sealed to the container. However, this solution creates certain additional problems. In the first place, conventional glass containers having flanged necks will be subject to minor dimensional variations such as variations in the thickness of the flange. This solution is not usable unless the containers are specially processed to minimize such variations, and the specially processed containers are relatively expensive. In addition, non standard componentry is required, and the resultant conversions are also expensive. Moreover, the member and sleeve can be removed with relative ease, and such removal is undesirable.

The present invention is directed toward a new and improved device for securing and sealing a dispenser to a glass container having a flanged neck which utilizes conventional containers with appreciable variations in the thickness of the flange, which does not employ non standard componentry and which once the device is in position, prevents subsequent removal of the device whereby the dispenser remains secured and sealed to the container.

SUMMARY OF THE INVENTION

In accordance with the principles of this invention, a device is employed to a dispenser having a circular outer periphery with a first diameter to the flanged open neck of a glass container. The flange has an inner periphery with a second and larger diameter and an outer periphery. The flange has a thickness which can be subject to minor dimensional variations.

The device employs a flat circular non metallic ring shaped gasket engaging the upper surface of the flange and a metal ferrule having a flat circular top with an opening through which the dispenser extends. The top overlies and engages the upper surface of the gasket. The ferrule includes a first or inner vertical hollow cylinder having an upper end coincident with the top. The cylinder extends downward along the outer vertical surface of the flange and has a lower end terminating in a plurality of spaced fingers.

A second or outer vertical hollow cylinder has a central opening through which the dispenser extends, the second cylinder extending vertically downward along the outside surface of the first cylinder past the spaced fingers. The inner surface of the second cylinder engages the fingers and forces them inwardly upwards until the fingers are disposed in locking engagement with the outer surface of the flange.

In one embodiment of the invention, the fingers have upper sections which extend inwardly toward the lower end of the flange and lower integral lower sections which extend outwardly away from the lower end of the flange. The inner surface of the second cylinder engages the lower sections and forces these lower sections inwardly upwards into locking engagement with the outer surface of the flange.

The second cylinder can have a horizontal groove on its inner surface which engages the lower ends of the lower sections of the fingers during the locking process.

Alternatively, the edge of the lower end of the second cylinder can be folded inwardly upon itself whereby a horizontal line of fold is created and engages the lower ends of the lower sections of the fingers during the locking process.

The ferrule can be modified so that the fingers sections define integral first and second curved sections, the first section curving outwardly and downwardly, the second section curving inwardly and upwardly. The second cylinder forces the first sections inwardly until the second curved sections are pivoted into locking engagement with the outer surface of the flange. When this modification is employed, the second cylinder can be removed after the curved portions are disposed in locking engagement with the outer surface of the flange, without subsequently weakening the locking engagement.

The net result of using any of the arrangements described above is that the dispenser is firmly secured to the container and cannot be separated therefrom without damaging the dispenser and/or the container.

DETAILED DESCRIPTION OF PREFERRED EMBODIMENTS

Figure 1:
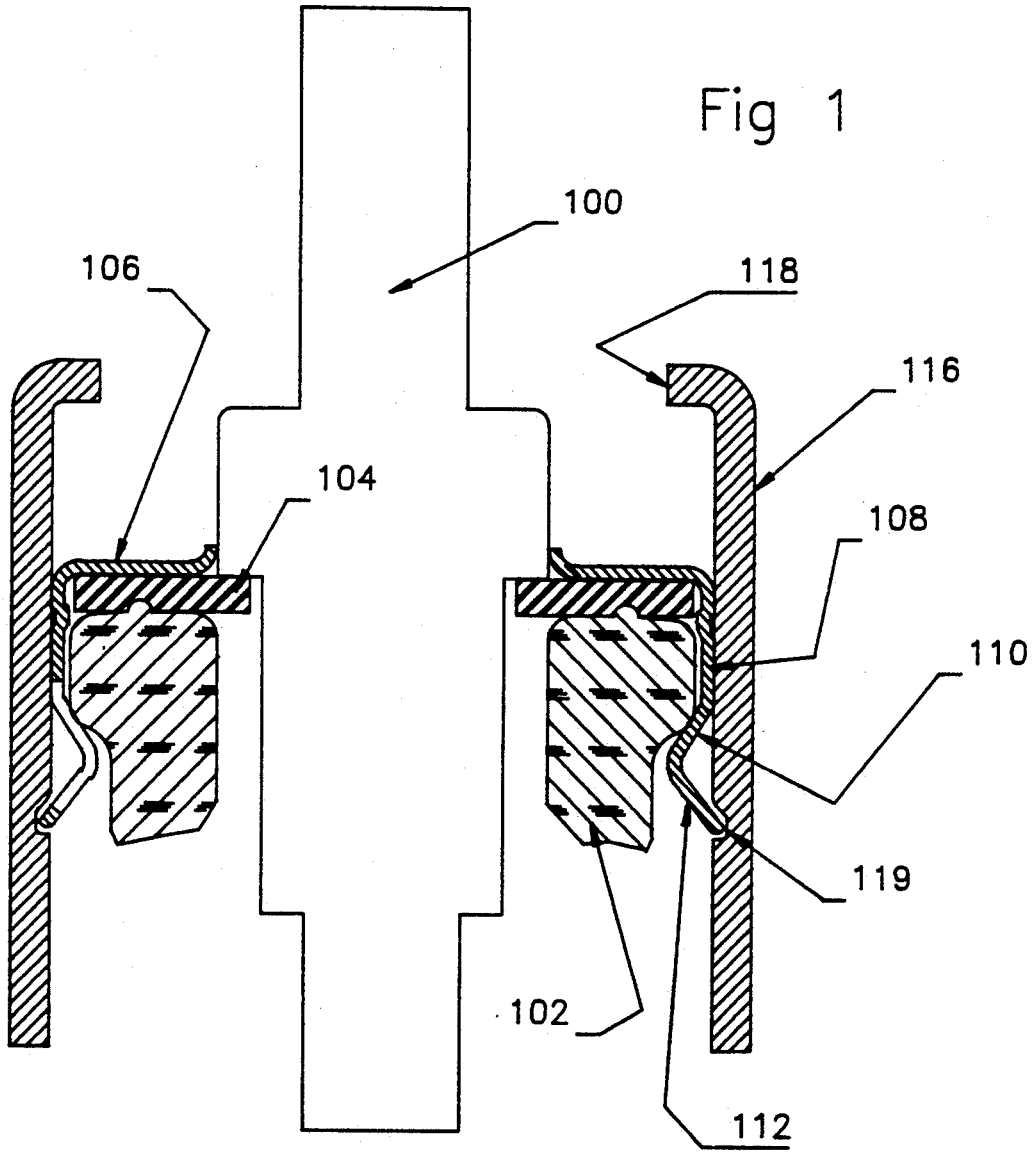
FIG. 1 is a vertical cross section of one embodiment of the invention.
Figure 2:
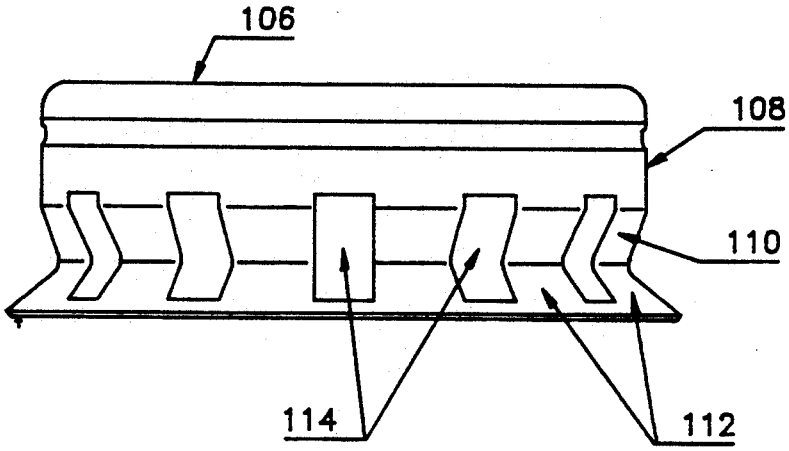
FIG. 2 is an enlarged detail view of a portion of the structure shown in FIG. 1.

Referring first to FIGS. 1 and 2, a dispenser 100 having a circular outer periphery with a first diameter is secured to a glass container having a flanged open neck 102. The flange has an inner periphery with a second and larger diameter and an outer periphery. The thickness of the flange is subject to minor dimensional variations. The flange has a vertical height subject to minor dimensional variations.

A device for connecting the dispenser to the container utilzes a flat circular non metallic ring shaped gasket 104 engaging the upper surface of the flange A metal ferrule has a flat circular top 106 with an opening through which the dispenser extends. The top overlies and engages the upper surface of the gasket. The ferrule has a vertical hollow cylinder 108 having an upper end coincident with the top. The cylinder extends downward along the outer vertical surface of the flange with a lower end terminating in a plurality of spaced fingers having upper sections 110 which extend inwardly toward the lower end of the flange and integral lower sections 112 which extend outwardly away from the lower end of the flange.

The ferrule can have a lower integral skirt into which spaced openings 114 are cut, the fingers being formed adjacent these openings.

A second vertical cylinder 116 which can be formed of metal or heavy plastic has a central opening 118 through which the dispenser extends. Cylinder 116 is pushed to extend vertically downward along the outside surface of the first cylinder past the spaced fingers, the inner surface of the second cylinder engaging the lower ends of the lower sections of the fingers and forcing them inwardly upwards until the upper sections of the fingers are disposed in locking engagement with the outer surface of the flange.

The engagement process can be facilitated by having a circular groove 119 inside cylinder 116 for engaging the lower ends of the lower sections of the fingers.

Figure 3:
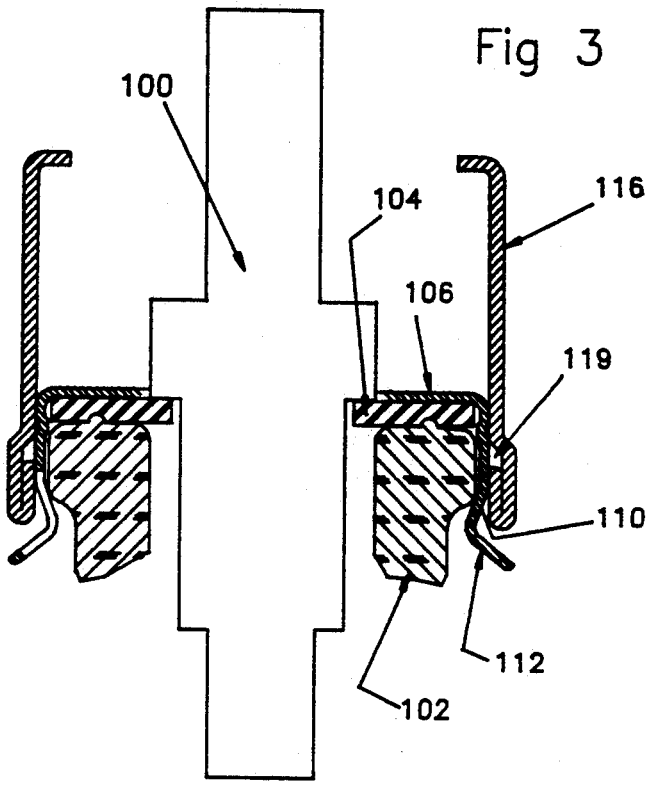
FIG. 3 is a view similar to FIG. 1 but showing a modification just prior to initiating the locking engagement process.
Figure 4:
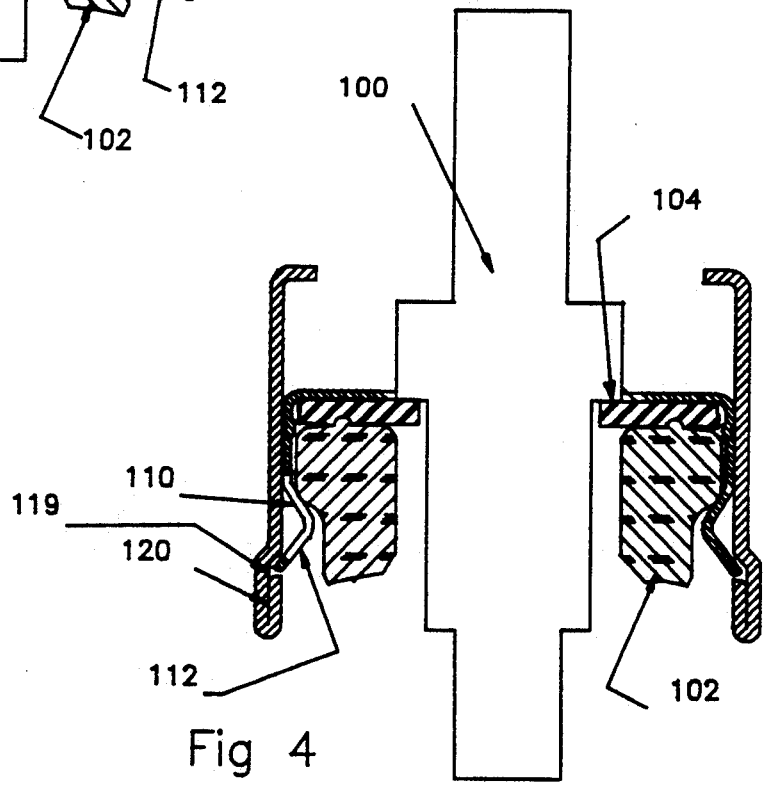
FIG. 4 is a view similar to FIG. 3 but showing the modification after the locking engagement process has been completed.

As shown in FIGS. 3 and 4, the lower edge of the cylinder 116 can be folded inwardly upon itself as shown at 120 to form the circular groove 119 which functions in the same manner as in FIG. 1.

Figure 5:
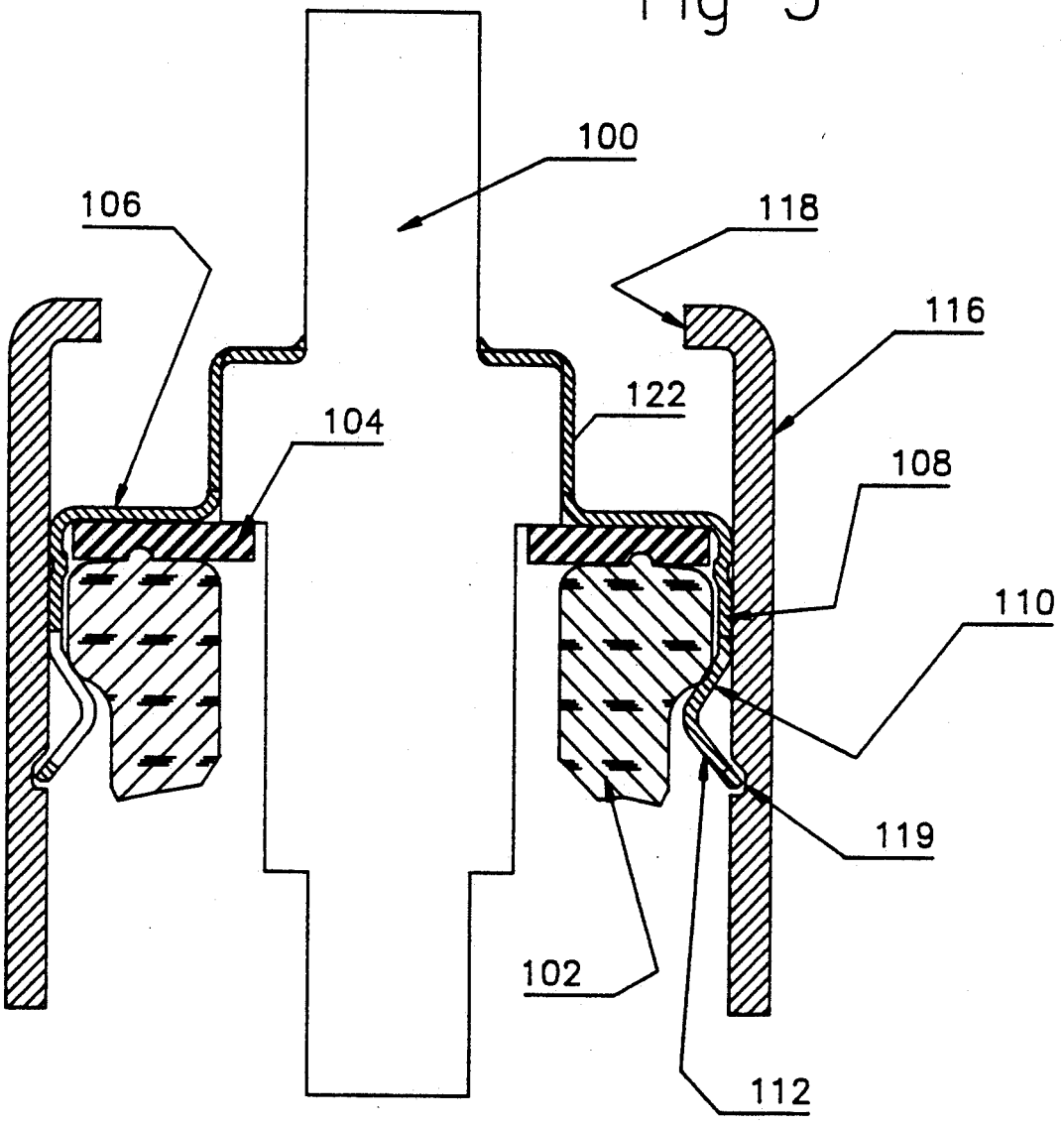
FIG. 5 is a view similar to FIG. 1 but illustrating a modified form of ferrule.
Figure 6:
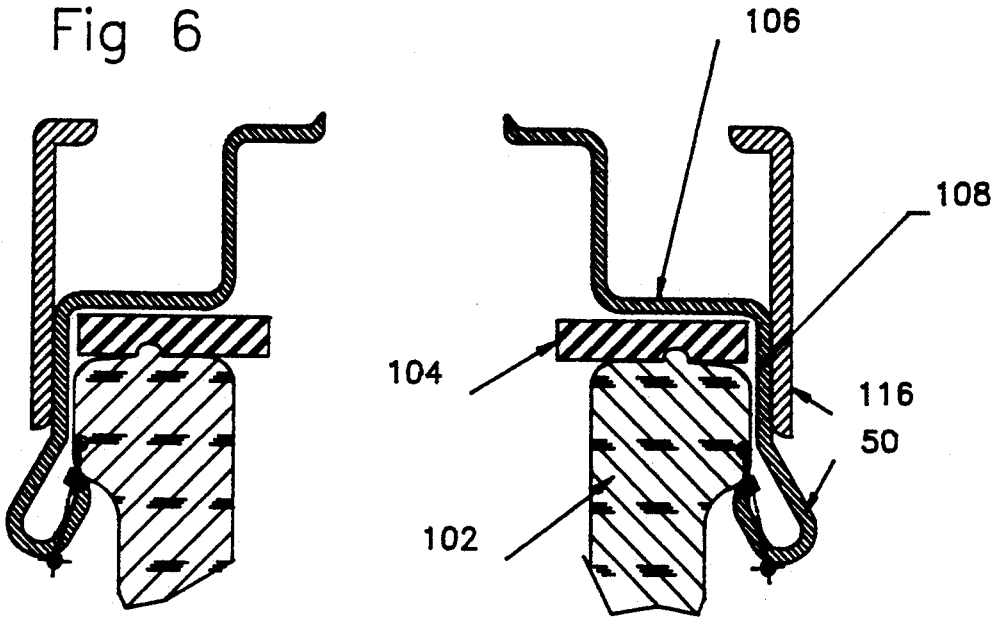
FIG. 6 illustrates a second embodiment of the invention just prior to initiating the locking engagement process.
Figure 7:
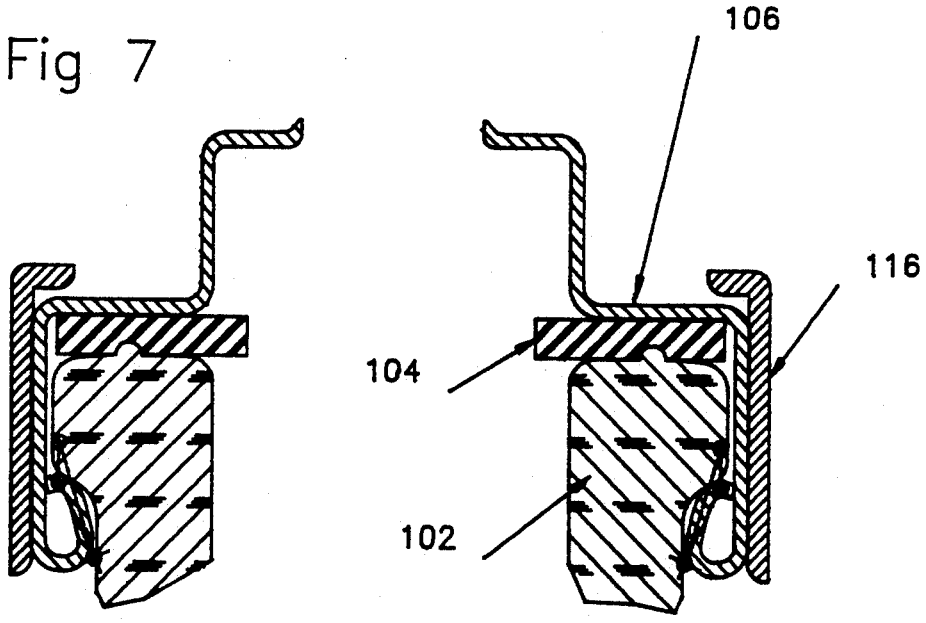
FIG. 7 is a view similar to FIG. 6 but showing the second embodiment after the locking engagement process has been completed.

As shown in FIG. 5, the ferrule can receive the dispenser and have an additional cylinder 122 which forms top 106 at its lower end. The remainder of the ferrule structure is identical to that shown in FIGS. 1–4.

Figure 10:
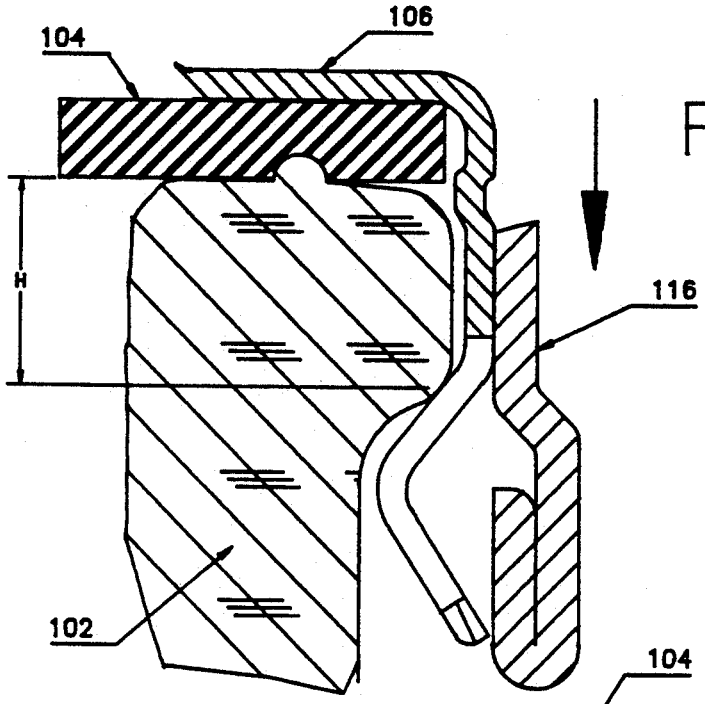
FIG. 10 is an enlarged detail view illustrating the locking engagement action of the structure shown in FIGS. 1–4 when the flange is relatively thin.
Figure 11:
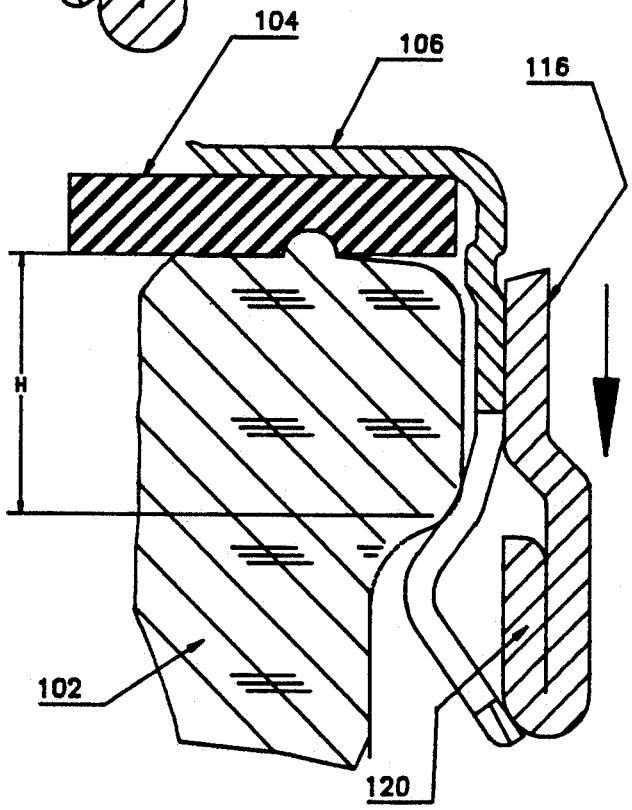
FIG. 11 is a view similar to FIG. 10 illustrating the locking engagement action when the flange is relatively thick.

As shown in FIGS. 10 and 11, the flange dimensions can vary somewhat to produce relatively thick or relatively thin flanges. In either situation, the point of bending can vary by moving inwardly or outwardly, but the tooth will wrap itself around the flange regardless of how thick it is.

As shown in FIGS. 6–9, each tooth can be formed into integral first and second curved sections 130 and 132. Section 130 extends outwardly and downwardly; section 132 extends inwardly and upwardly. Each tooth forms a two bar toggle. There are three pivots, 52, 54 and 56. Pivot 54 is disposed at the free end of section 132. Pivot 52 is disposed on the outside of the flange above pivot 54. Pivot 56 is disposed adjacent a lower portion of section 132 below pivot 54. The total distance which is the sum of distance between pivots 52 and 54 and the distance between pivots 54 and 56 is longer than the distance measured directly between pivots 52 and 56.

Figure 8:
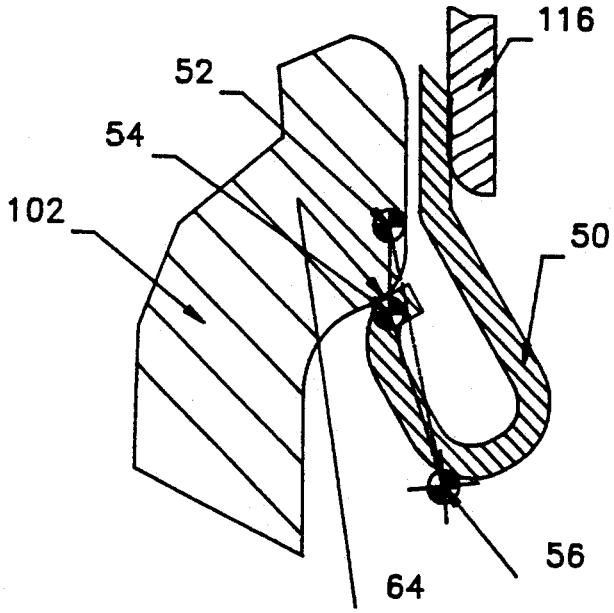
FIG. 8 is an enlarged detail view of a portion of the structure shown in FIG. 6.
Figure 9:
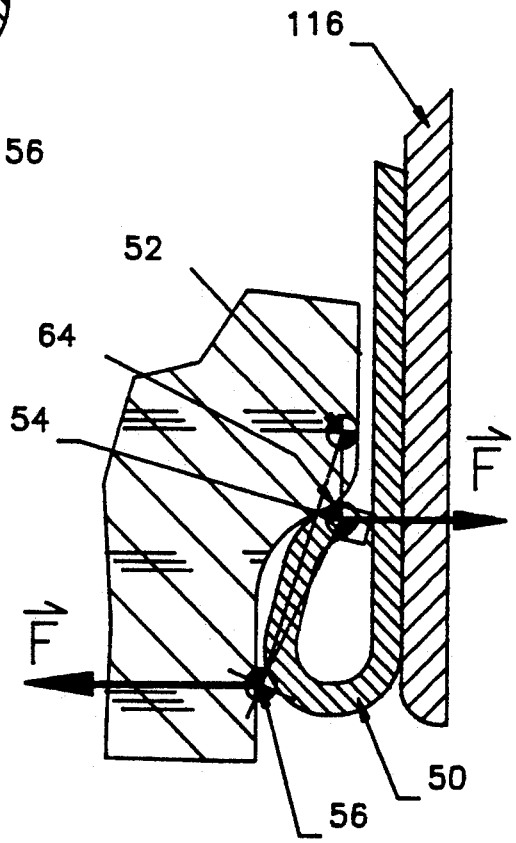
FIG. 9 is an enlarged detail view of a portion of the structure shown in FIG. 7.

The pivot 54 is a central pivot which in the unlocked position lies away from and towards the inside of a line connecting pivots 52 and 54 as shown in FIG. 8. Pivot 54 touches the lower outside surface of the flange as shown at 64 after the second or outer cylinder 116 has been disposed around the ferrule.

When the second cylinder is pushed downward, it forces tooth sections 132 into vertically downwardly extending positions aligned with the second cylinder. This action causes pivot 56 to rotate around pivot 54, forcing pivot 56 to increase its separation from pivot 52. After pivot 56 passes the position where all three pivots are aligned, it snaps inward and pivot 54 is again located away from the line connecting pivots 52 and 56 and towards the outside of the line.

Figure 12:
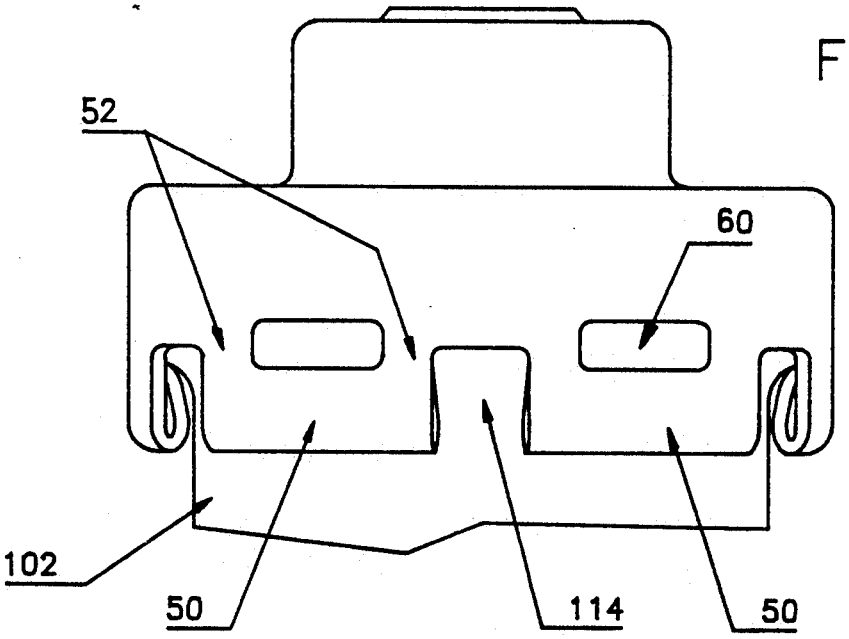
FIG. 12 shows the structure of FIG. 7 after the second cylinder has been removed.

Once the teeth are so deformed, the resulting forces on the teeth are in the direction indicated with "F". These forces will secure the ferrule in place, firmly connecting the dispenser to the container, even if the second cylinder is subsequently removed as shown in FIG. 12.

While the invention has been described with particular emphasis on the drawings and preferred embodiments, the protection sought is to be limited only by the terms of the claims which follow.

What is claimed is:

1. A device for connecting a dispenser having a circular outer periphery with a first diameter to a glass container having a flanged open neck, the flange having an inner periphery with a second and larger diameter and an outer periphery, the thickness of the flange being subject to minor dimensional variations, said device comprising:

a flat circular non metallic ring shaped gasket engaging the upper surface of the flange;

a metal ferrule having a flat circular top with an opening through which the dispenser extends, the top overlying and engaging the upper surface of the gasket, and a vertical hollow cylinder having an upper end coincident with the top, the cylinder extending downward along the outer vertical surface of the flange and having a lower end terminating in a plurality of spaced fingers; and a second vertical cylinder having a central opening through which the dispenser extends, the second cylinder extending vertically downward along the outside surface of the first cylinder past the spaced fingers, the inner surface of the second cylinder engaging the fingers and forcing them into locking engagement with the outer surface of the flange.

2. A device for connecting a dispenser having a circular outer periphery with a first diameter to a glass container having a flanged open neck, the flange having an inner periphery with a second and larger diameter and an outer periphery, the thickness of the flange being subject to minor dimensional variations, said device comprising:

a flat circular non metallic ring shaped gasket engaging the upper surface of the flange;

a metal ferrule having a flat circular top with an opening through which the dispenser extends, the top overlying and engaging the upper surface of the gasket, and a vertical hollow cylinder having an upper end coincident with the top, the cylinder extending downward along the outer vertical surface of the flange and having a lower end terminating in a plurality of spaced fingers having upper sections which extend inwardly toward the lower end of the flange and lower integral lower sections which extend outwardly away from the lower end of the flange; and a second vertical cylinder having a central opening through which the dispenser extends, the second cylinder extending vertically downward along the outside surface of the first cylinder past the spaced fingers, the inner surface of the second cylinder engaging the lower ends of the lower sections of the fingers and forcing them inwardly upwards until the upper sections of the fingers are disposed in locking engagement with the outer surface of the flange.

3. The device of claim 2 wherein the second cylinder has a horizontal groove on its inner surface which engages the lower ends of the lower sections of the fingers to enhance the locking engagement.

4. The device of claim 3 wherein the edge of the lower end of the second cylinder is folded inwardly upon itself whereby a horizontal line of fold is created and engages the lower ends of the lower sections of the fingers during the locking process.

5. The device of claim 1 wherein each tooth has integral first and second curved sections, and wherein before the second cylinder extends downwardly, the first section extends outwardly and downwardly and the second section extends upwardly and inwardly, and wherein, after the second cylinder extends downwardly, the first sections are moved vertically downward into vertical alignment with the first cylinder and the second sections are pivoted about their free ends into locking engagement with the flange.

6. A device for connecting a dispenser having a circular outer periphery with a first diameter to a glass container having a flanged open neck, the flange having an inner periphery with a second and larger diameter and an outer periphery, the thickness of the flange being subject to minor dimensional variations, said device comprising:

a flat circular non metallic ring shaped gasket engaging the upper surface of the flange;

a metal ferrule having a flat circular top with an opening through which the dispenser extends, the top overlying and engaging the upper surface of the gasket, and a vertical hollow cylinder having an upper end coincident with the top, the cylinder extending downward along the outer vertical surface of the flange and having a lower end terminating in a plurality of spaced fingers, each finger being disposed into curved locking engagement with the outer surface of the flange.

* * * * *